United States Patent [19]

Pietsch

[11] 4,023,793

[45] May 17, 1977

[54] DEVICE FOR THE SIDE-REGISTERING OF SHEETS

[75] Inventor: Erich Pietsch, Offenbach-Bieber, Germany

[73] Assignee: Roland Offsetmaschinenfabrik Faber & Schleicher AG., Germany

[22] Filed: Aug. 4, 1976

[21] Appl. No.: 711,581

[30] Foreign Application Priority Data

Aug. 6, 1975 Germany ..... 2535062

[52] U.S. Cl. ..... 271/252; 271/241

[51] Int. Cl.[2] ..... B65H 9/10

[58] Field of Search ..... 271/252, 250, 248, 249, 271/226, 241

[56] References Cited

UNITED STATES PATENTS

| | | | |
|---|---|---|---|
| 2,712,936 | 7/1955 | Backhouse | 271/252 |
| 2,730,362 | 1/1956 | Koch | 271/252 |

*Primary Examiner*—Johnny D. Cherry
*Assistant Examiner*—Bruce H. Stoner, Jr.
*Attorney, Agent, or Firm*—Leydig, Voit, Osann, Mayer & Holt, Ltd.

[57] ABSTRACT

A wiper mechanism for lateral shifting of a sheet against a side guide defining a registered reference position. The mechanism includes an oscillated wiper arm under the sheet having an arcuate sheet-engaging wiper surface with a tap roller for pressing the sheet against the wiper surface during the outward movement of the arm. The wiper surface has axially adjacent strips surfaced for different amounts of friction. The roller has an effective width corresponding to the width of one of the strips and is movable into a position of engagement with a selected strip for changing the degree of friction applied to the sheet depending upon the thickness of the sheet being handled.

4 Claims, 2 Drawing Figures

FIG. 1
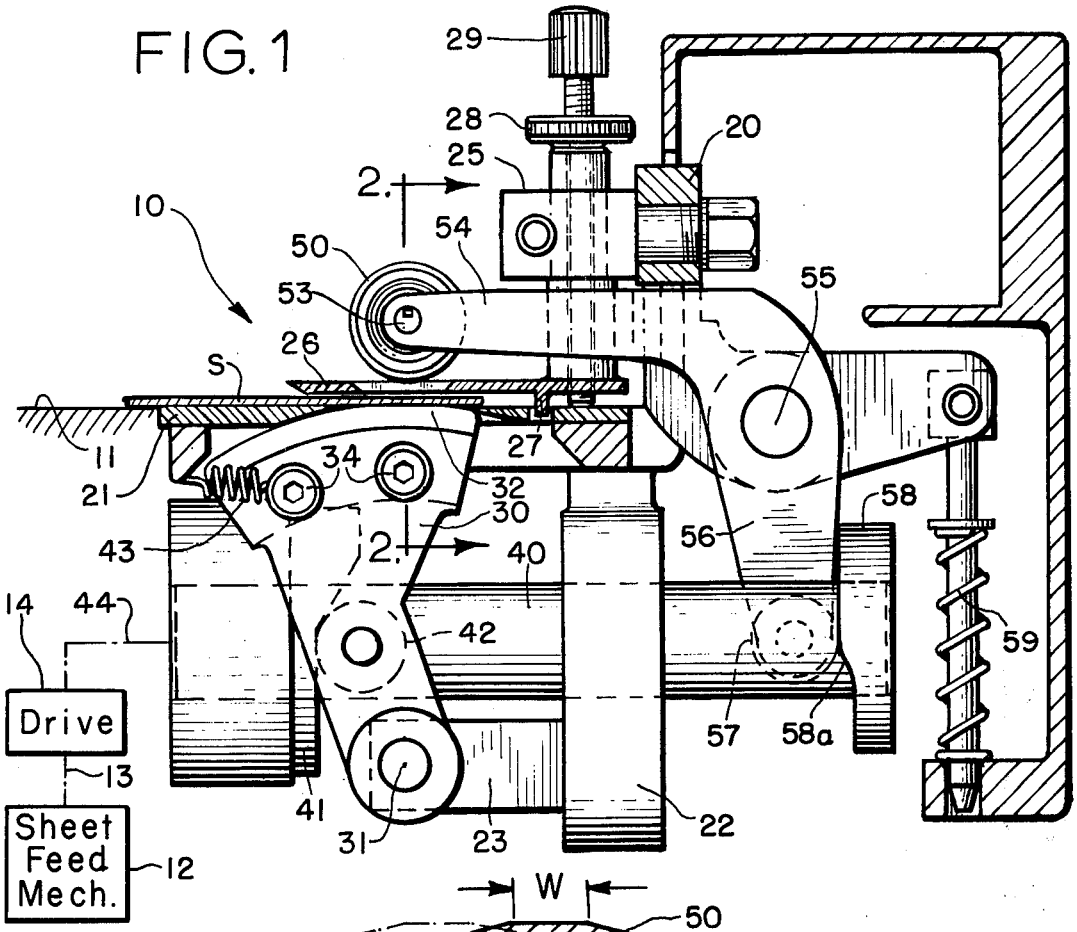
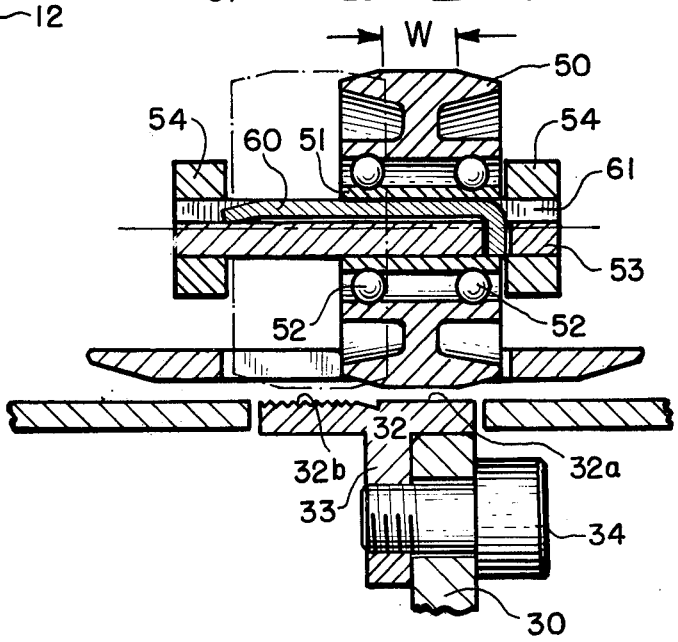
FIG. 2

DEVICE FOR THE SIDE-REGISTERING OF SHEETS

It is known to provide a wiper engaging the underside of a sheet for moving the sheet against a side guide or lateral stop, for registration purposes (see German Auslegeschriften DT-AS No. 1,105,009, DT-AS No. 1,027,691, DT-AS No. 1,028,586, DT-AS No. 1,148,563 and German Patentschriften Nos. 863,659 and 680,459). In such devices the frictional surfaces must be changed when going from one grade of paper to another, for example from thin tissue to cardboard. Such change is difficult and time consuming and hence expensive.

It is, therefore, an object of the present invention to provide a wiper mechanism which is instantly convertible for different grades of paper. It is a related object to provide a wiper mechanism for obtaining lateral register of successively fed sheets which is economical to make and use, in which changeover for sheets of widely different thickness requires no more than a flick of the wrist, but which is nevertheless, inherently reliable and long-lived, involving no more care or maintenance than wiping devices of conventional design.

It is a further object of the invention to provide a wiper and side guide assembly for positioning a succession of sheets in which the guide and wiping structure forms a unitary assembly which may be widely utilized in presses and other devices requiring accurate positioning of a succession of sheets.

Other objects and advantages of the invention will become apparent upon reading the attached detailed description and upon reference to the drawings in which:

FIG. 1 is an elevational view of a wiper mechanism constructed in accordance with the present invention. FIG. 2 is an enlarged section taken along line 2—2 in FIG. 1.

While the invention has been described in connection with a preferred embodiment, it will be understood that I do not intend to be limited to the particular embodiment shown but intend, on the contrary, to cover the various alternative and equivalent constructions included within the spirit and scope of the appended claims.

Turning now to the drawing there is disclosed a sheet positioning assembly 10 located adjacent a sheet-supporting surface 11 which may, for example, be the feed table of a lithograph press. As viewed in FIG. 1, a sheet S is proceeding toward the viewer, having been released by a sheet feed mechanism 12 of conventional design. The feed mechanism has a synchronized drive connection 13 to the press drive 14. The sheet positioning assembly includes a frame 20 having a supporting surface 21 which is substantially flush with the table surface 11 and which includes a depending bracket 22 having an arm 23. Secured to the frame 20 is a stop assembly 25 having at its lower end a plate 26 having integrally formed on its underside a rib 27 which is interposed in the path of lateral movement of the sheet and which may be horizontally and vertically positioned by adjustments 28, 29, which adjustments, however, do not form a part of the present invention. The rib 27 forms a lateral stop or side guide.

A wiper arm is provided under the support 21 and having an arcuate, sheet-engaging wiper surface which engages the underside of the sheet, with means for oscillating the wiper arm outwardly in the direction of the side guide and subsequent inward return movement. In the present instance the wiper arm 30 is pivoted at its lower end 31 on the arm 23 of the supporting bracket, the axis of pivoting being parallel to the direction of forward movement of the sheet but perpendicular to the lateral wiping movement. At its upper end the arm 30 has an arcuate sheet engaging wiper surface 32 which is preferably formed on a wiping segment 33 which is held in place on the arm by clamping screws 34.

For the purpose of swinging the arm 30 outwardly for movement of the sheet against the side guide 27, the arm is oscillated by means of a drive shaft having a cam and cam follower. The drive shaft, indicated at 40, carries a cam 41 of circular contour which bears against a cam follower 42 on the arm. A tension spring 43 connected to the upper end of the arm maintains the cam follower constantly biased against the cam surface. The drive shaft 40 is connected to the press and delivery drive 14 by a synchronizing mechanical connection 44.

For pressing the sheet S downwardly into frictional engagement with the wiper surface 32 during a portion of the outward movement of the wiper arm, a relatively movable "tap" roller is arranged in opposed position above the wiper surface. The tap roller, indicated at 50, is mounted on a bushing 51 with an anti-friction bearing 52 in between to assure free rotation. The roller bushing 51 is mounted upon a shaft 53 secured to a bifurcated bracket 54 which is centrally pivoted at 55 to the frame to form a bell crank having a downwardly extending leg 56. Mounted at the lower end of the leg 56 is a cam follower roller 57 which engages the face of a cam 58 mounted upon the drive shaft 40. The roller 57 is maintained bottomed on the cam face by a spring 59. The lobe on the cam 58 is of such arcuate length and so phased with respect to the lobe of the cam 41 that the roller 50 is lowered, pressing the sheet into frictional engagement with the wiper surface 32, only during the course of the outward movement of the arm, the roller being held in upraised position during the return movement. Preferably, as shown in the drawing, the wiper surface 32 is positioned just slightly below the plane of the supporting surface 21 so that when the roller is in its upraised position the sheet is free of any frictional drag imposed by the arm.

In accordance with the present invention the wiper surface 32 is formed of axially adjacent strips surfaced for different amounts of friction, the roller having an effective width approximately corresponding to the width of one of the strips, and with means for enabling relative axial shifting of the roller into a position opposite a selected one of the strips for changing the degree of friction exerted upon the sheet. Thus the wiper surface 32, in the present embodiment, is formed of axially adjacent strips **32*a*, 32*b*, the strip 32*a* being relatively smooth for engagement of sheets of thin gage while the strip 32*b* is roughened, for example by knurling, to produce the increased friction required for the lateral wiping of sheets of heavier gage such as cardboard. The roller 50, which has an effective width W corresponding to only one of the strips, is relatively shiftable along its axis so that it may be manually brought into opposed register with either the strip 32*a* or the strip 32*b***.

To accommodate the shifting movement, the shaft 53 which supports the bushing 51 upon which the roller is mounted is elongated between the bifurcations 54, thereby permitting the roller 50 to be manually slid between the full line position illustrated in FIG. 2 and the position indicated by the dot-dash outline. To maintain the roller 50 in a selected one of its two positions, the inside of the bushing 51 is engaged by a leaf spring 60 which is recessed in a groove 61 formed in the shaft 53.

The wiper mechanism is shown in FIG. 2 in a condition in which the tap roller 50 is alined with the relatively smooth frictional strip 32*a* of the wiper arm, as appropriate for sheets of relatively thin gage. In operation the sheet S is fed down the feed table, in the direction of the viewer, under the control of the sheet feed mechanism 12 during a time when the roller 50 occupies its upwardly retracted position so that the sheet is unobstructed and thereby free to bottom on suitable front guides (not shown). As the drive shaft 40 rotates to advance the lobe of the cam 41 against the cam follower 42 to move the arm, the cam follower 57 reaches a point of drop-off 58*a* (FIG. 1) on the cam 58, thereby lowering the roller into contact with the sheet, pressing the sheet against the wiper surface 32*a* so that the sheet is laterally shifted by wiping action, against the lateral stop, or side guide, 27 thereby placing the sheet in a laterally registered reference position. Immediately thereafter the cam follower 57 is again engaged by the lobe of the cam 58 to raise the roller 50 clear of the sheet during the return movement of the wiper arm under the urging of spring 43 upon retreat of cam 41. Since the two cams 41, 58 are both keyed to the drive shaft 40, and since the drive shaft 40 is interlocked by connections 44, 13 to the sheet feed mechanism 12, the timing, once adjusted, is consistently maintained even at high feed rates.

When it is desired to change from the printing of thin sheets to the printing of heavy stock such as cardboard, all that is required is the shifting of the tap roller 50 to the dot-dash position illustrated in FIG. 2, which may be done with a light manual force, and with the roller thereafter being in opposed position to the roughened surface 32*b*. The roller is maintained in its new position by reason of the frictional engagement between the leaf spring 60 and the inner wall of the bushing 51. This changeover, which can be accomplished in the wink of an eye and, in any event, in much less time than it takes to tell about it, is to be contrasted with the time and labor required in a conventional sheet registering mechanism to change the wiper surface to one having a different amount of friction appropriate to the gage of the sheet.

The term "portion of the outward movement" of the oscillating arm refers to any portion up to 100 percent. However, the invention includes the possibility of using a continuous arcuate surface 32, continuously driven in the same direction about pivot 31 by the drive shaft 40. This may be readily accomplished by completing the segment 33 so that it occupies an arc of 360° and by providing a continuous drive connection, preferably a set of bevel gears, between the segment and the drive shaft.

It will be apparent that the assembly 10, including the frame 20 and all of the parts secured thereto, forms a compact, self-contained and unitary assembly which may be integrated into the edge of a feed table or, indeed, installed wherever it is desired to laterally shift successively fed sheets into a registered reference position.

What I claim is:

1. In a wiper mechanism for lateral shifting of a sheet into a registered reference position, the combination comprising means defining a sheet supporting surface, a side guide adjacent the supporting surface for engaging and thereby positioning the edge of the sheet, a wiper arm mounted under the supporting surface and having an arcuate sheet-engaging wiper surface engaging the underside of the sheet, means for oscillating the wiper arm outwardly in the direction of the side guide with subsequent inward return movement, a tap roller in opposed position above the wiper surface for pressing the sheet downwardly thereon, means for coupling the roller and arm so that the roller is limited to pressing engagment during a portion of the outward movement of the arm, the wiper surface having axially adjacent strips surfaced for different amounts of friction, the roller having an effective width corresponding to the width of one of the strips, and means for enabling relative axial shifting of the roller into a position of selective engagment with one of the strips for changing the degree of friction applied to the sheet in accordance with the thickness of the sheet being handled.

2. In a wiper mechanism for lateral shifting of a sheet into a registered reference position, the combination comprising means defining a sheet supporting surface, a side guide adjacent the supporting surface for engaging and thereby positioning the edge of the sheet, a wiper arm mounted under the supporting surface and having an arcuate sheet-engaging wiper surface engaging the underside of the sheet, means for oscillating the wiper arm outwardly in the direction of the side guide with subsequent inward return movement, a tap roller above the wiper surface for pressing the sheet downwardly thereon, a bracket for mounting the roller, means for coupling the bracket to the arm so that the roller is lowered during a portion of the outward movement of the arm but raised out of sheet engagement during the return movement thereof, the wiper surface on the arm having axially adjacent strips surfaced for different amounts of friction, the rolller having an effective width corresponding to the width of one of the strips, the roller bracket including provision for axial shifting of the roller into register with a selected one of the strips for changing the degree of friction applied to the sheet depending upon the thickness of the sheet being handled.

3. The combination as claimed in claim 2 in which a bushing is interposed between the tap roller and the bracket, with the roller being freely rotatable on the bushing and the bushing being axially slideable on the bracket, and means for holding the bushing in a selected axial position with respect to the bracket.

4. In a wiper mechanism for lateral shifting of a sheet into a registered reference position, the combination comprising means defining a sheet supporting surface, a side guide adjacent the supporting surface for engaging and thereby positioning the edge of the sheet, a drive shaft, a wiper member mounted under the supporting surface and having an arcuate sheet-engaging wiper surface engaging the underside of the sheet, means coupled to the drive shaft for rotating the wiper member so that the wiper surface moves outwardly in the direction of the side guide, a tap roller above the wiper surface for pressing the sheet downwardly thereon, a bracket for mounting the roller, means for coupling the bracket to the drive shaft so that the roller is cyclically lowered and raised, the wiper surface having axially adjacent strips surfaced for different amounts of friction, the roller having an effective width corresponding to the width of one of the strips, the roller bracket including provision for axial shifting of the roller into register with a selected one of the strips for changing the degree of friction applied to the sheet depending upon the thickness of the sheet being handled.

* * * * *